US005666833A

United States Patent [19]

Gao et al.

[11] Patent Number: 5,666,833

[45] Date of Patent: Sep. 16, 1997

[54] REINFORCING APPARATUS FOR A LEVER HANDLE OF A DOOR LOCK

[75] Inventors: Sheen-Youl Gao, Yun-Lin Hsien; Rong-Faa Wu, Chia-Yi Hsien; Ming-Shyang Chiao, Chia-Yi City; Cheng-Wen Lai, Chia-Yi Hsien; San-Yi Lin, Yun-Lin Hsien; Ching-Chuan Kuo; Lan-Kun Don, both of Chia-Yi Hsien, all of Taiwan

[73] Assignee: Tong-Lung Metal Industry Co., Ltd., Taiwan

[21] Appl. No.: 361,186

[22] Filed: Dec. 21, 1994

Related U.S. Application Data

[63] Continuation-in-part of Ser. No. 312,705, Sep. 27, 1994, abandoned.

[51] Int. Cl.[6] ..... E05B 13/10

[52] U.S. Cl. ..... 70/224; 292/336.3; 292/DIG. 61

[58] Field of Search ..... 70/224, DIG. 36, 70/DIG. 54; 292/336.3, 356, 347, DIG. 61, 357

[56] References Cited

U.S. PATENT DOCUMENTS

| | | | |
|---|---|---|---|
| 3,075,796 | 1/1963 | Russell et al. | 292/336.3 |
| 5,265,924 | 11/1993 | Kim | 292/336.3 |
| 5,286,074 | 2/1994 | Lin | 292/336.3 |
| 5,322,333 | 6/1994 | Norton, II et al. | 292/336.3 |
| 5,335,948 | 8/1994 | Norton, II et al. | 292/336.3 X |
| 5,481,890 | 1/1996 | Millman | 292/336.3 X |

*Primary Examiner*—Lloyd A. Gall
*Attorney, Agent, or Firm*—Ladas & Parry

[57] ABSTRACT

A reinforcing apparatus for a lever handle of a door lock includes a housing fixed to a door and provided around a driving shaft of the door lock. The housing has a wall transverse to the driving shaft. The wall has a hole formed therethrough for passage of the driving shaft. A rotary member is mounted in the housing for rotating simultaneously with the driving shaft. The rotary member is sleeved on the driving shaft and has an engaging plate which projects axially from an outer peripheral edge thereof. A coiled spring is provided around the rotary member for biasing the rotary member to return and maintain the lever handle at its original unoperated position after the rotary member is rotated by the lever handle. The coiled spring has two legs extending radially outwardly to abut against the engaging plate. One of the legs is displaceable by the engaging plate. The housing further includes a stopping unit provided on the wall thereof. The stopping unit is aligned radially with and is located outwardly of the engaging pate when the lever handle is in the unoperated position. The other one of the legs is kept immobilized by the stopping unit when the rotary member rotates.

15 Claims, 10 Drawing Sheets

REINFORCING APPARATUS FOR A LEVER HANDLE OF A DOOR LOCK

CROSS REFERENCE TO RELATED APPLICATION

This is a continuation-in-part (CIP) application of U.S. patent application No. 08/312,705, filed on Sep. 27, 1994 by some of the applicants of this invention, which is abandoned.

BACKGROUND OF THE INVENTION

1. Field of the Invention

This invention relates to a reinforcing apparatus for a lever handle of a door lock, more particularly to a reinforcing apparatus which can return and maintain the lever handle at its original unoperated position after the lever handle is operated to lock or unlock the door lock.

2. Description of the Related Art

The improvement of this invention is directed to a conventional door lock, as shown in FIG. 2, which includes a latch housing (A), a driving mechanism that consists of a retractable bolt-operating unit (B) and a pair of driving shafts (C), a pair of mounting caps (D), a knob (E), and a lever handle (F).

Referring to FIGS. 1 and 2, the latch housing (A) is mounted on a door (not shown) and has a pair of outer sleeves (A') extending axially outward from two opposite sides of the latch housing (A). The retractable bolt-operating unit (B) is mounted within the latch housing (A) for actuating a bolt (not shown) of the door lock in order to lock or unlock the door lock. The driving shafts (C) extend axially outward from the bolt-operating unit (B) through the outer sleeves (A') of the latch housing (A) respectively, and engage the retractable bolt-operating unit (B) by means of two driving flanks (C') so as to operate the bolt-operating unit (B) when the driving shafts (C) are rotated. The outer sleeves (A') have outwardly threaded portions located at exteriors of two opposite outer side walls of the door. The mounting caps (D) are mounted threadably and respectively on the outwardly threaded portions of the outer sleeves (A') and are connected threadably to the opposite outer side walls of the door, thereby fixing the door lock on the door. The knob (E) is connected to the right one of the driving shafts (C) for operating the bolt-operating unit (B) via the right driving flank (C') when the knob (E) is rotated. A compression spring (G) is disposed within the latch housing (A) for biasing the bolt-operating unit (B) to its original unoperated position where the right driving shaft (C) and the knob (E) are returned to their original unoperated positions. The lever handle (F) is connected to the left one of the driving shafts (C) and has the same function as that of the knob (E).

Because the center of gravity of the knob (E) is located at the axis of the right driving shaft (C), there is no torque formed between the axis of the right driving shaft (C) and the center of gravity of the knob (E). Accordingly, the compression spring (G) does not suffer from elastic fatigue even if the knob (E) has been used for a long period.

However, since the center of gravity of the lever handle (F) is located apart from the axis of the left driving shaft (C), a torque is formed between the axis of the left driving shaft (C) and the center of gravity of the lever handle (F). Thus, the compression spring (G) suffers easily from elastic fatigue after the lever handle (F) has been operated for many times. As a result, it is difficult to maintain the lever handle (F) at its original unoperated position only by means of the compression spring (G). Moreover, the left driving shaft (C) is liable to damage due to the application of excess operating forces on the lever handle (F). Thus, the door lock may easily break down.

The basic U.S. patent application No. 08/312,705 discloses a reinforcing apparatus for a lever handle of a door lock. The door lock has a driving mechanism which is to be mounted on a door for actuating a bolt of the door lock in order to lock or unlock the door lock. The driving mechanism has a driving shaft which extends axially and outwardly therefrom. The lever handle is connected to the driving shaft for operating the driving mechanism so as to actuate the bolt.

The reinforcing apparatus includes a housing which is provided around the driving shaft and which is fixed to the door, a rotary member which is received in the housing and which is mounted to the driving shaft for rotating simultaneously with the driving shaft, and means for biasing the rotary member to return and maintain the lever handle at its original unoperated position after the rotary member is rotated by the lever handle. The biasing means is mounted to the housing. The housing has a housing part with a wall transverse to the driving shaft, and a covering part opposite to the wall of the housing part. The wall of the housing part has a hole formed therethrough for passage of the driving shaft and a recessed area formed around the hole to receive the rotary member. The covering part is connected to the housing part so as to enclose the rotary member within the housing part. The rotary member has an annular plate sleeved on the driving shaft. The annular plate has an engagement tongue which projects radially and inwardly from an inner circumferential edge thereof to engage the driving shaft, and a pair of positioning lugs which project axially from an outer circumferential edge thereof and which are spaced diametrically from each other. The biasing means includes a flat spiral spring which is mounted on the annular plate and which has two legs that extend radially outward to abut respectively against the positioning lugs of the annular plate. The housing further includes a pair of diametrically opposite stopping protrusions formed on the wall of the housing part. Each of the stopping protrusions is aligned radially with and is located outwardly of a respective one of the positioning lugs of the annular plate. The stopping protrusions are engageable with the legs of the flat spiral spring.

SUMMARY OF THE INVENTION

The main objective of the present invention is to provide a reinforcing apparatus which is used for a lever handle of a door lock and which employs a fewer number of parts to achieve its purpose of returning and maintaining he lever handle at its unoperated position after the lever handle is operated to lock or unlock the door lock even after the lever handle has been operated for many times.

According to this invention, a reinforcing apparatus, which is used for a lever handle of a door lock, includes a housing, a rotary member and a coiled spring.

The door lock has a driving mechanism which is to be mounted to a door for actuating a bolt of the door lock in order to lock or unlock the door lock. The driving mechanism has a driving shaft which extends axially and outwardly therefrom. The lever handle is connected to the driving shaft for operating the driving mechanism so as to actuate the bolt.

The housing is provided around the driving shaft and is fixed to the door. The housing has a wall transverse to the driving shaft, and a stopping means provided on the wall. The wall has a hole formed therethrough for passage of the driving shaft.

The rotary member is mounted in the housing for rotating simultaneously with the driving shaft. The rotary member is sleeved on the driving shaft, and has an outer peripheral edge and an engaging means which projects axially from the outer peripheral edge.

The coiled spring is provided around the rotary member for biasing the rotary member to return and maintain the lever handle at its original unoperated position after the rotary member is rotated by the lever handle. The coiled spring has two legs that extend radially and outwardly to abut against the engaging means. One of the legs of the coiled spring is displaceable by the engaging means. The housing further includes a stopping means which is aligned radially with and which is located outwardly of the engaging means of the rotary member when the lever handle is in the unoperated position. The other one of the legs of the coiled spring is kept immobilized by the stopping means when the rotary member rotates.

The engaging means has an engaging plate which projects axially from the outer peripheral edge of the rotary member. The engaging plate has two opposite axial engaging edges which engage the legs of the coiled spring, respectively.

The stopping means is a protrusion which is provided on and which projects axially from the wall of the housing.

Preferably, the reinforcing apparatus further includes means for retaining the rotary member within the housing to prevent release of the rotary member from the housing, and means for confining rotation of the rotary member within a predetermined angle so as to avoid overrotation of the coiled spring.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

A pair of reinforcing apparatuses of the first preferred embodiment of this invention are applied respectively to a pair of lever handles of a door lock in order to return and maintain the lever handles at their original unoperated positions.

Figure 8:
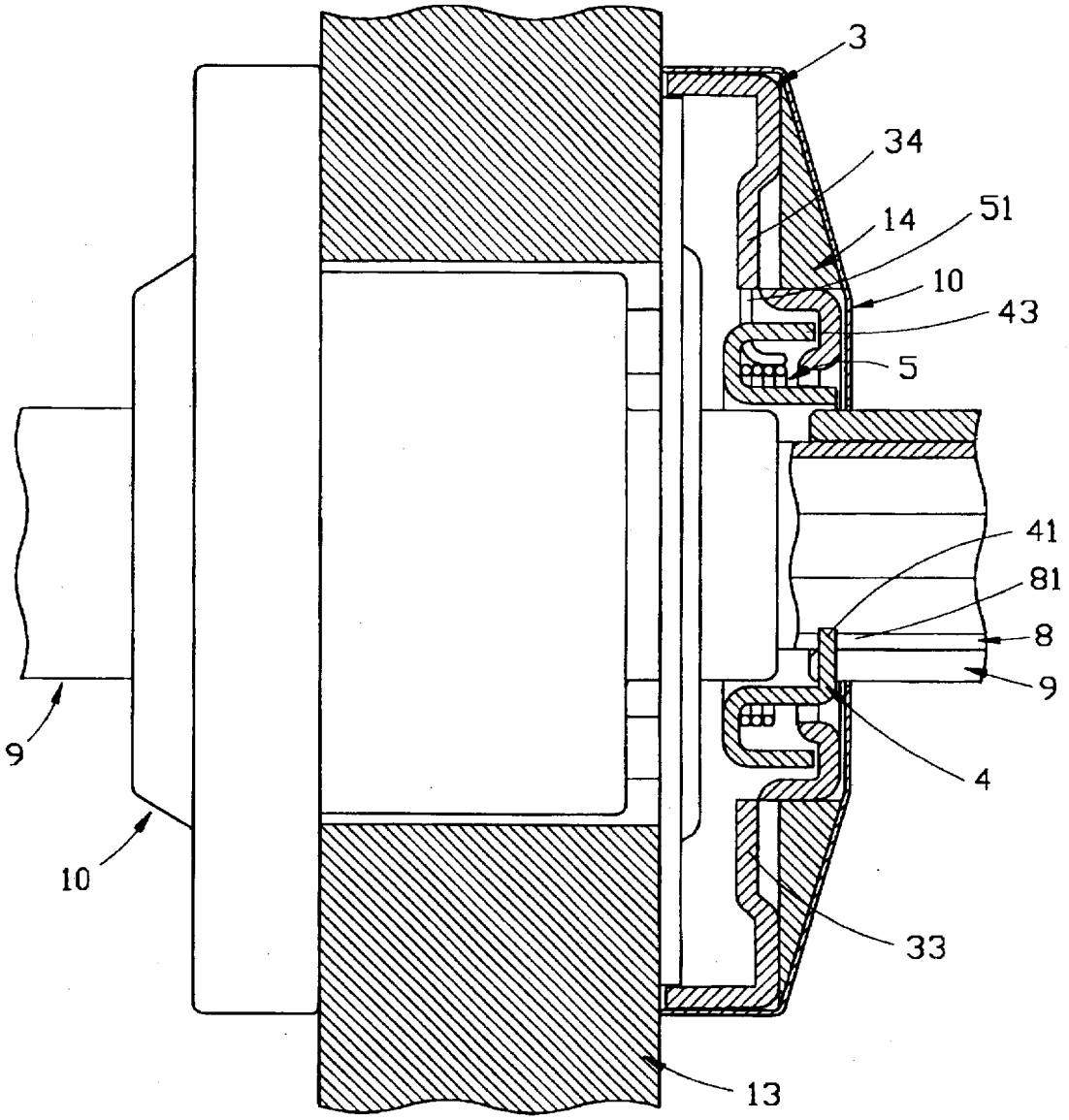
FIG. 8 is a schematic view illustrating how the reinforcing apparatus of this invention is mounted to a door lock for reinforcing a lever handle of the door lock.

Referring to FIG. 8, the door lock includes a driving mechanism which is to be mounted to a door 13 for actuating a bolt (not shown) of the door lock in a known manner in order to lock or unlock the door lock. The driving mechanism has a pair of driving shafts 8 (only one is shown) which extend axially and outwardly therefrom. A pair of lever handles 9 are connected to this driving shafts 8 for operating the driving mechanism in a known manner so as to actuate the bolt. A pair of mounting caps 10 are provided respectively around the shaft portions of the lever handles 9 and are fixed respectively to two opposite side walls of the door 13 for covering a pair of left and right reinforcing apparatuses (only the right one is shown) of this invention, thereby constituting a finished door lock on the door 13. The space between each of the left and right reinforcing apparatuses and a respective one of the mounting caps 10 is provided with an annular stuffing member 14 for reinforcing the mounting caps 10 during use.

Each of the left and right reinforcing apparatuses includes a housing 3 provided around a respective one of the driving shafts 8, a rotary member 4 received in the housing 3 and mounted to the corresponding one of the driving shafts 8 for rotating simultaneously with the corresponding driving shaft 8, and a coiled spring 5 provided around the rotary member 4 for biasing the rotary member 4 to return and maintain a respective one of the lever handles 9 to its original unoperated position after the rotary member 4 is rotated by the corresponding lever handle 9. It is noted that the left one of the reinforcing apparatuses is similar in function and in construction to the right one of the reinforcing apparatuses. Accordingly, only one of the left and right reinforcing apparatuses will be described in the following paragraphs.

Referring to FIGS, 3, 4 and 5, housing 3 has a wall 30 transverse to the corresponding driving shaft 8 (see FIG. 8). The wall 30 has a hole 31 formed therethrough for passage of the corresponding driving shaft 8, an inner tubular wall portion 32 which confines the hole 31 and which has an annular projection 321 which extends radially and inwardly therefrom, and first and second protrusions 33, 34 which are formed integrally with and which project axially from the wall 30 of the housing 3. The annular projection 321 has two radial notches 322 which are diametrically opposite to each other. The first and second protrusions 33, 34 are similarly diametrically opposite to each other and extend angularly and inwardly from the wall 30. Two positioning holes 35 are formed through the wall 30 of the housing 3.

The housing is further provided with diametrically opposing indentations 38 and slots 39.

Figure 9:
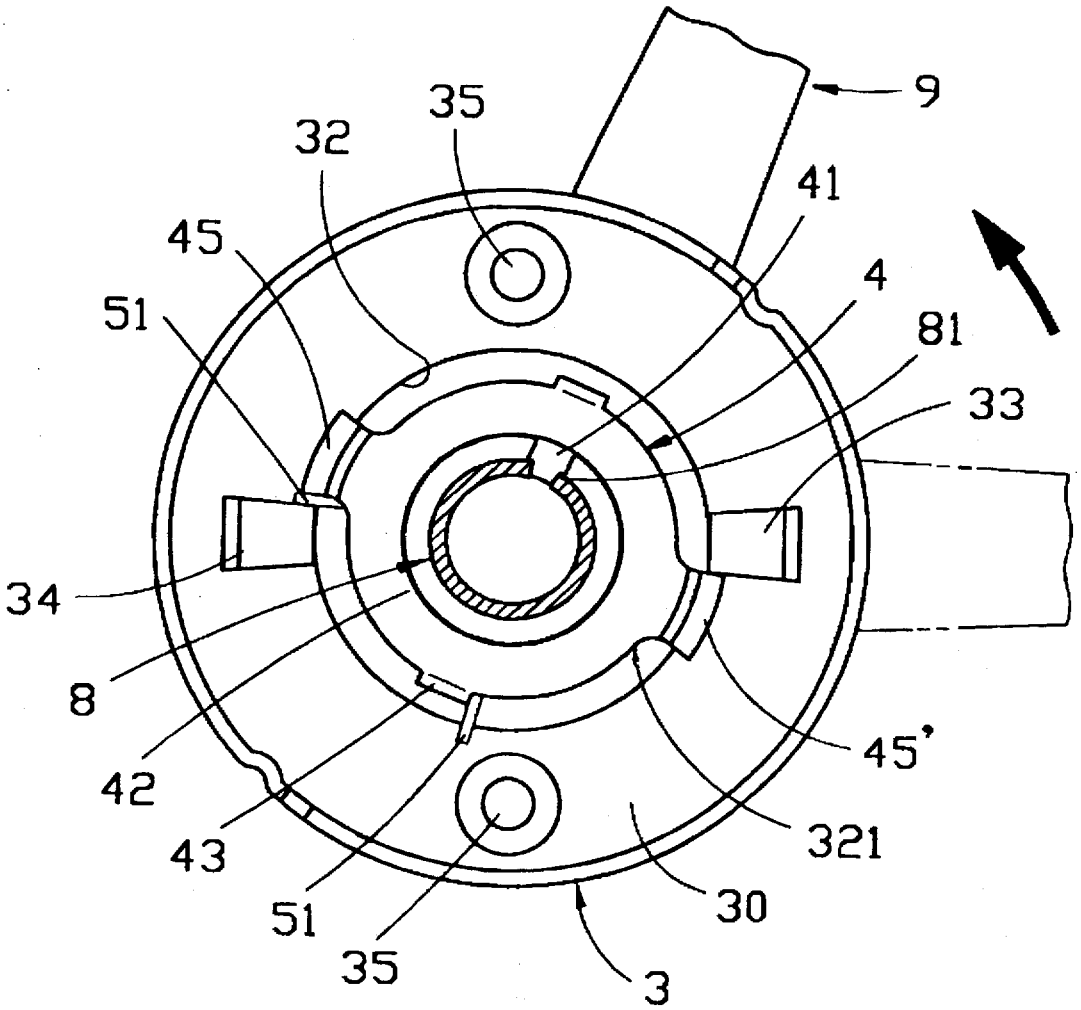
FIG. 9 is a schematic view illustrating the actuation of the reinforcing apparatus when the lever handle of the door lock is rotated along a counterclockwise direction.

The rotary member 4 includes a tubular portion 40 which is surrounded by the inner tubular wall portion 32 of the housing 3 and which is in sliding contact with the annular projection 321 of the inner tubular wall portion 32. In addition, the tubular portion 40 is sleeved on the corresponding driving shaft 8 (see FIG. 8). An engagement tongue 41 projects radially and inwardly from an inner face of one end of the tubular portion 40 to engage an opened-ended slot 81 of the corresponding driving shaft 8 in a known manner, as shown in FIGS. 8 and 9. Accordingly, the tubular portion 40 can rotate simultaneously with the corresponding driving shaft 8 when the lever handle 9, which is connected to the corresponding driving shaft 8, is actuated.

Figure 1:
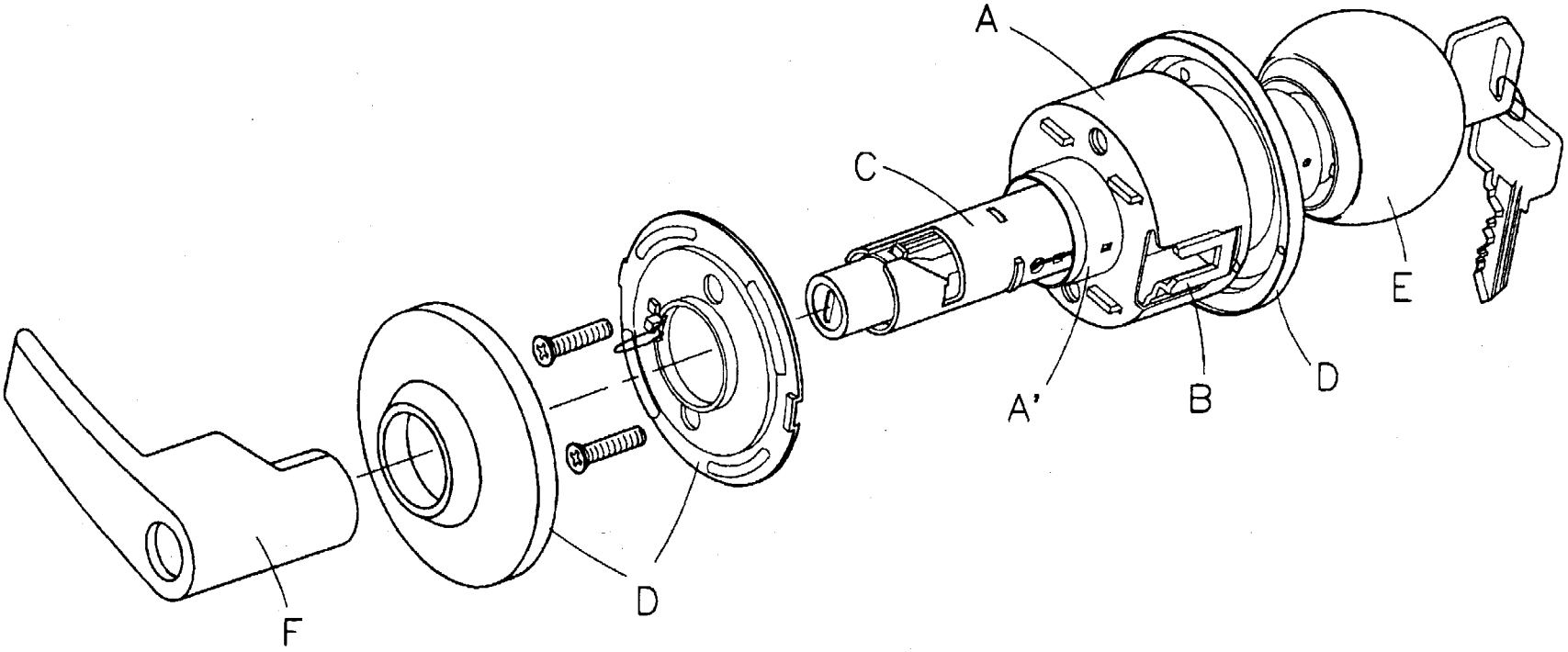
FIG. 1 (PRIOR ART)
FIG. 1 is an exploded view of a conventional door lock.
Figure 2:
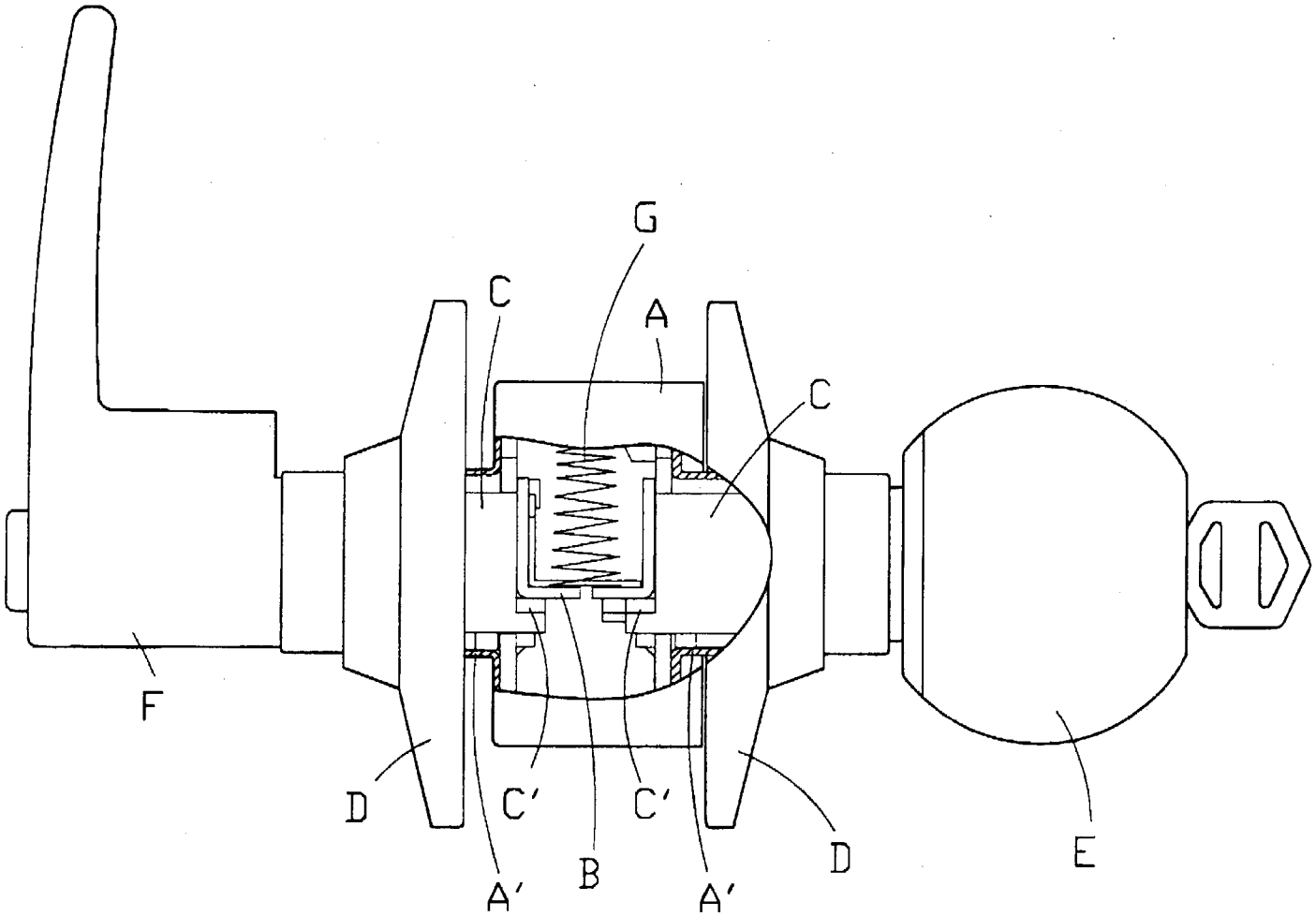
FIG. 2 PRIOR ART
FIG. 2 is a schematic view illustrating the conventional door lock when assembled.
Figure 3:
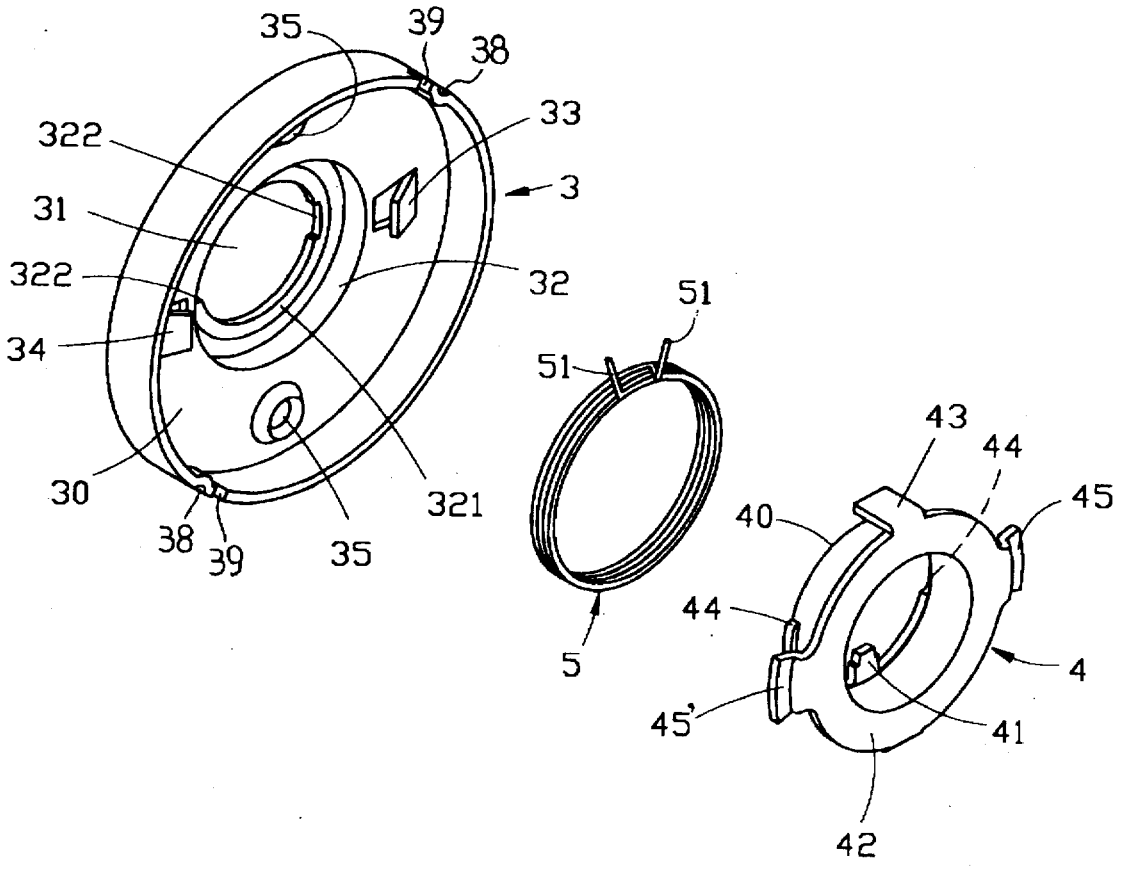
FIG. 3 is an exploded view showing a reinforcing apparatus of the first preferred embodiment of this invention.
Figure 4:
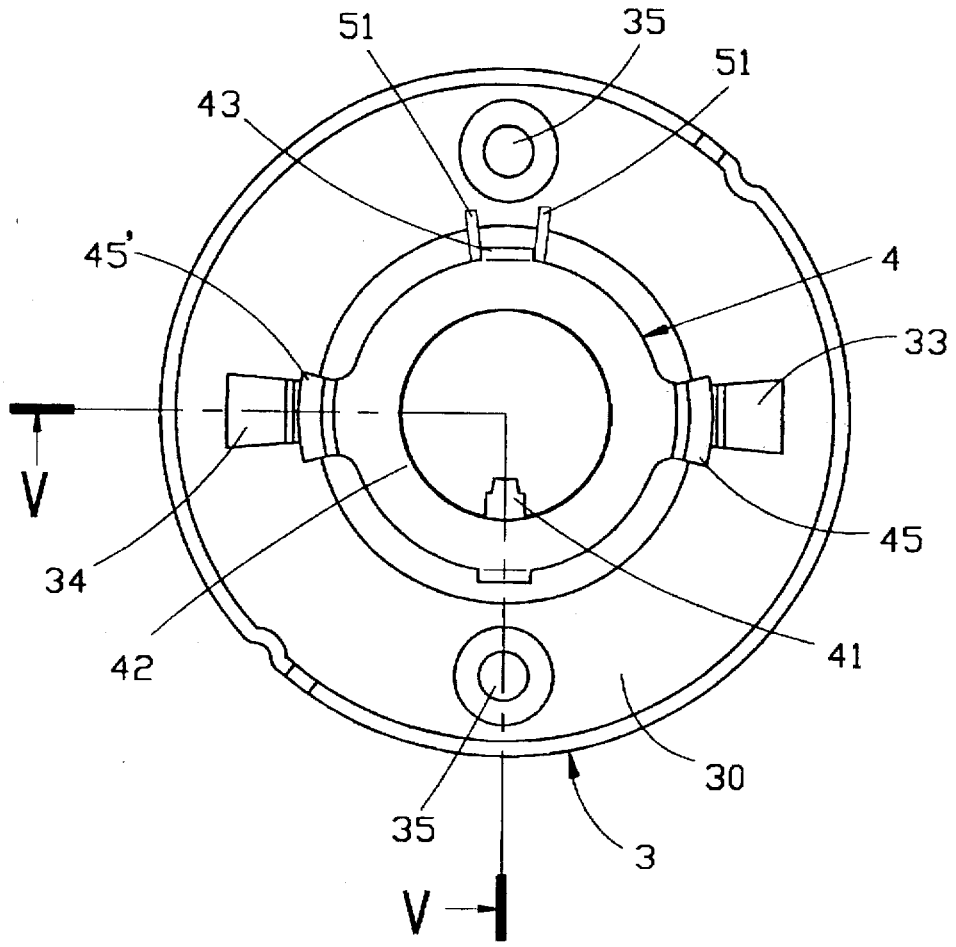
FIG. 4 is a schematic view illustrating how the reinforcing apparatus is assembled in accordance with this invention.
Figure 5:
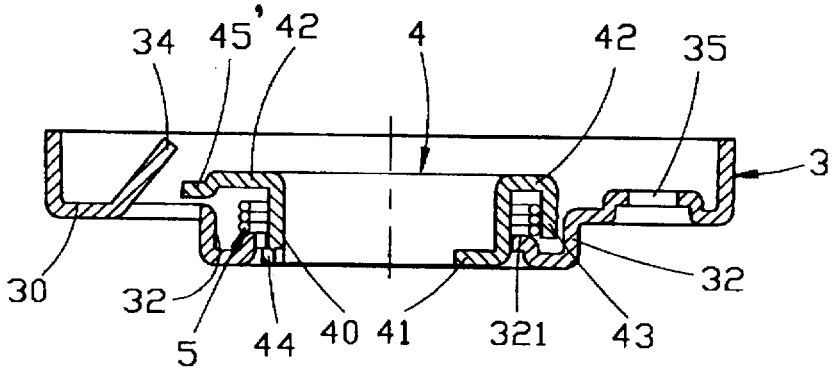
FIG. 5 is a sectional view, taken along the line V—V of FIG. 4, showing the reinforcing apparatus of this invention.

Referring again to FIGS. 3, 4 and 5, the rotary member 4 further includes an annular flange 42 which projects outwardly from an outer face of the other end of the tubular portion 40, an engaging plate 43 which projects axially from an outer peripheral edge of the annular flange 42, a pair of retaining noses 44 which project radially and outwardly from an outer face of one end of the tubular portion 40 and which are spaced apart from each other, and a pair of lugs 45, 45' which project radially and outwardly from the outer peripheral edge of the annular flange 42 and which are spaced diametrically from each other.

Figure 6:
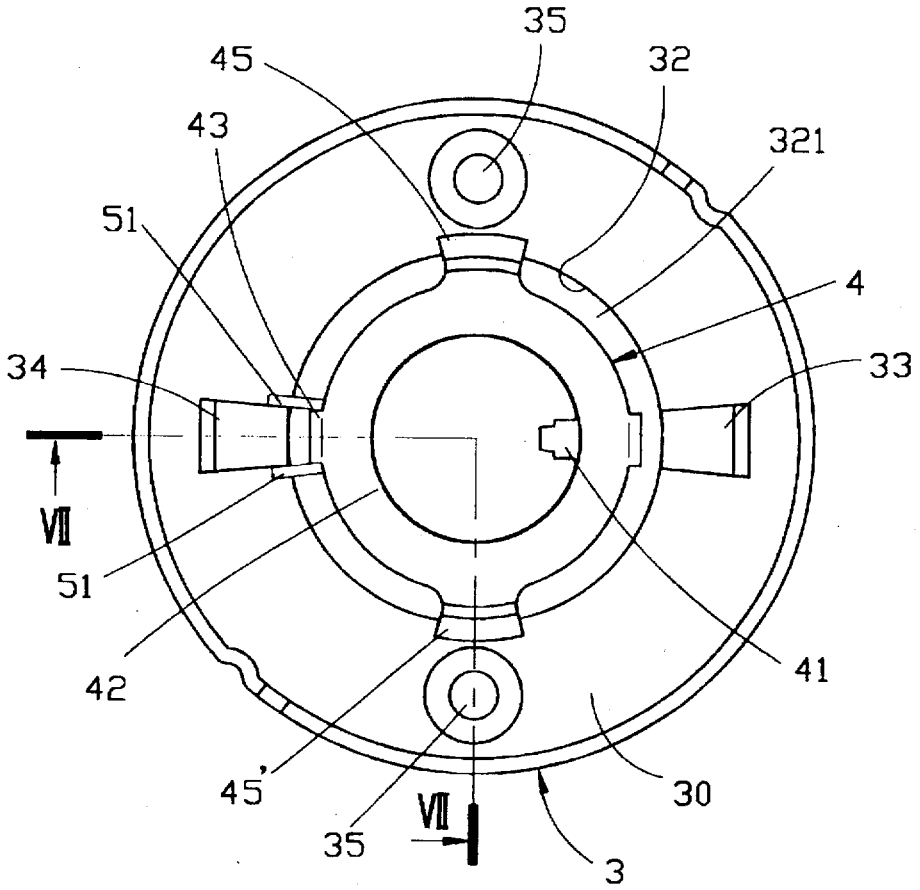
FIG. 6 is an elevational side view showing the assembly of the reinforcing apparatus according to this invention.
Figure 7:
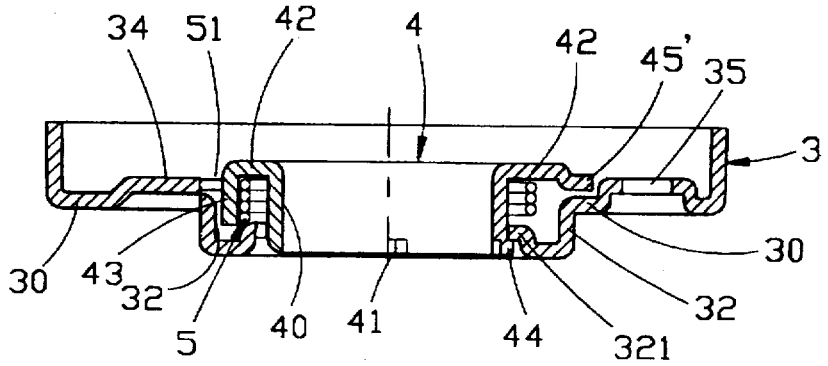
FIG. 7 is a sectional view, taken along the line VII—VII of FIG. 6, illustrating the assembly of the reinforcing apparatus in accordance with this invention.

When it is desired to mount the rotary member 4 on the housing 3, the retaining noses 44 are passed respectively through the radial notches 322 of the annular projection 321 of the wall 30 and are then turned to an angularly distant location with respect to the notches 322, as shown in FIGS. 6 and 7. In this way, the retaining noses 44 can be positioned to engage an outer face of the annular projection 321 so that the retaining noses 44 act as a retaining means for retaining the rotary member 4 within the housing 3 to prevent release of the rotary member 4 from the housing 3. At the same time, the engaging plate 43 is aligned radially with and is located inwardly of the second protrusion 34 when the lever handle 9 (see FIG. 8) is in its unoperated position. The first and second protrusions 33, 34 are then pressed slightly toward the wall 30 to a flat state (see FIG. 7) with the use of a tool (not shown).

The coiled spring 5 is sleeved around the tubular portion 40 of the rotary member 4 and is retained between the annular projection 321 and the annular flange 42. The coiled spring 5 has two legs 51 that extend radially and outwardly to abut against two opposite axial engaging edges of the engaging pate 43. The distal ends of the legs 51 of the coiled spring 5 are supported respectively by two opposite axial sides of the second protrusion 34. Accordingly, a torsion force in the coiled spring 5 can counteract the torque generated by an eccentric position of the center of gravity of the lever handle 9 with respect to the axis of the driving shaft 8 so as to maintain the lever handle 9 at its original unoperated lever position even after a long-term use. The engaging plate 43 acts as an engaging means for pushing selectively one of the legs 51 when the rotary member 4 is rotated by virtue of the lever handle 9. The second protrusion 34 acts as a stopping means for maintaining immobility of one of the legs 51 of the coiled spring 5 when the other one of the legs 51 of the coiled spring 5 is pushed by the engaging plate 43 due to rotation of the rotary member 4, as shown in FIGS. 9 and 10.

Figure 10:
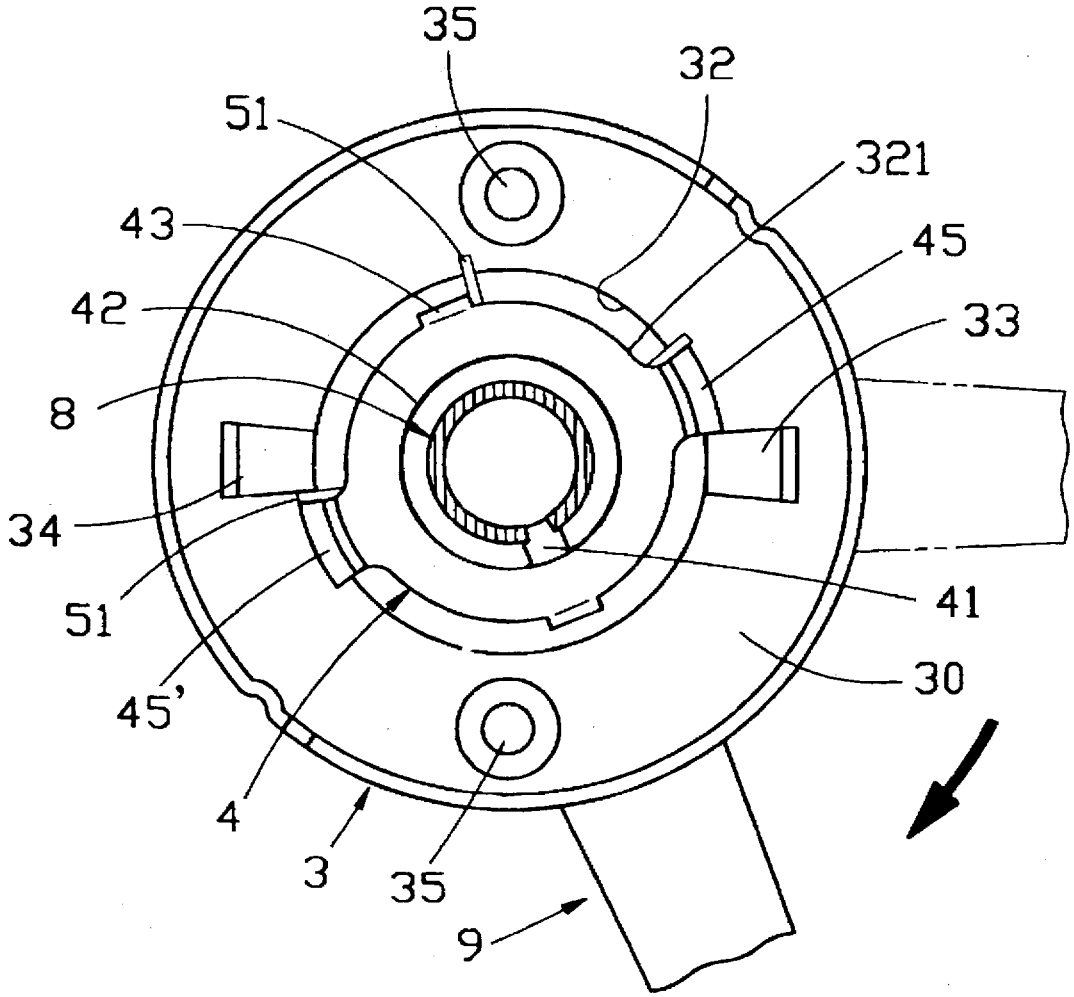
FIG. 10 is a schematic view illustrating the actuation of the reinforcing apparatus when the lever handle of the door lock is rotated along a clockwise direction.

When the lever handle 9 is rotated along a counterclockwise direction (as shown in FIG. 9) or along a clockwise direction (as shown in FIG. 10) to actuate the driving mechanism of the door lock, the rotary member 4 can be rotated to push one of the legs 51 of the coiled spring 5, by means of the engaging plate 43, apart from the second protrusion 34. As the same time, another leg 51 of the coiled spring 5 is blocked by the second protrusion 34. Accordingly, the torsion force which is being gradually stored in the coiled spring 5 will cause the handle lever 9 to return to its original unoperated position immediately after the force applied to rotate the lever handle 9 is removed. In addition, the first protrusion 33 of the housing 3, which acts as a confining means, can on the one hand, prevent further rotation of the lug 45' of the rotary member 4 when the lever handle 9 rotates along the counterclockwise direction (as shown in FIG. 9) and on the other hand, prevent further rotation of the lug 45 when the lever handle 9 rotates along the clockwise direction (as shown in FIG. 10) so as to confine rotation of the rotary member 4 within an angle of about 90°, thereby avoiding overrotation of the coiled spring 5.

It is noted that the second protrusion 34 of the housing 3 can also act as a confining means to block the lug 45 of the rotary member 4 when the lever handle 9 rotates along the counterclockwise direction, as shown in FIG. 9, and to block the lug 45' of the rotary member 4 when the lever handle 9 rotates along the clockwise direction, as shown in FIG. 10.

Referring again to FIGS. 3 and 8, the reinforcing apparatus is fixed to the door 13 by means of two bolts (not shown) which extend respectively through the positioning holes 35 of the housing 3 to engage the corresponding side wall of the door 13 in a known manner. Then, the corresponding mounting cap 10 is provided to cover the reinforcing apparatus as described hereinbefore.

Figure 11:
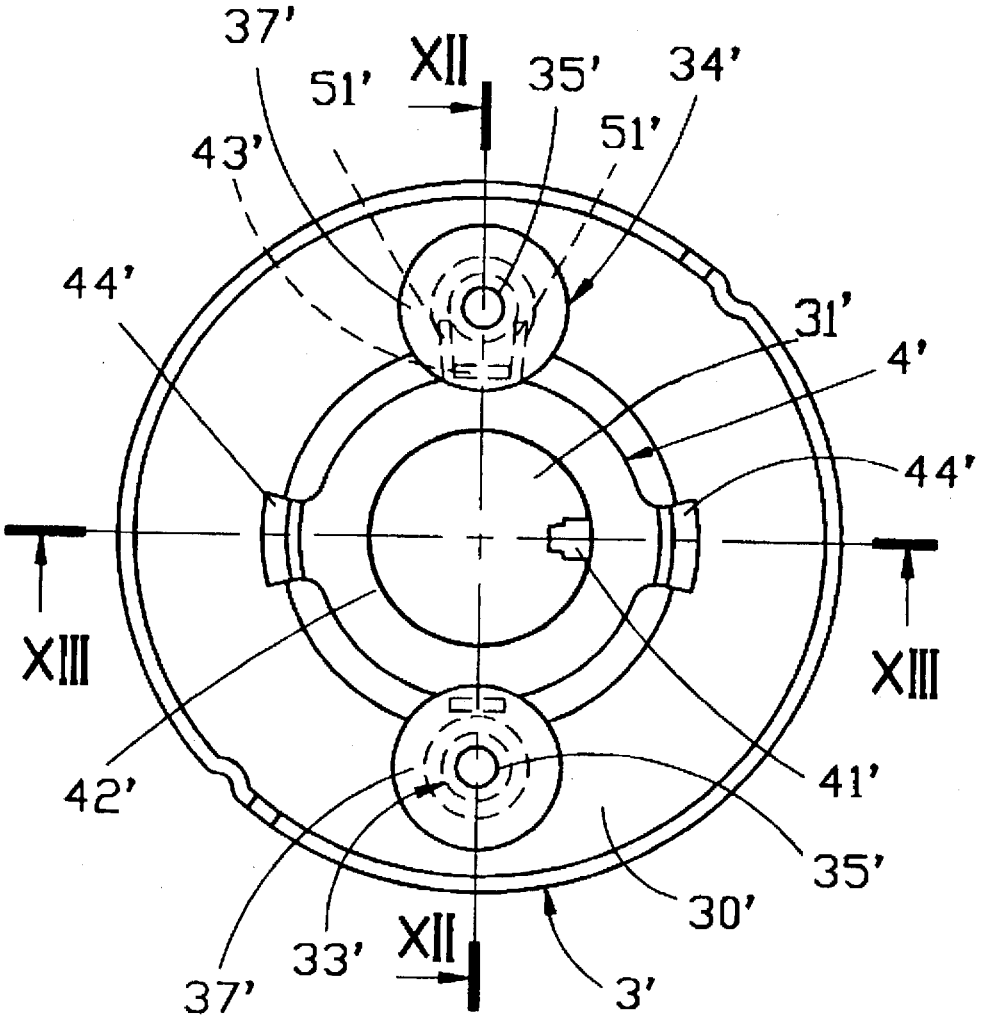
FIG. 11 is an elevational side view showing the assembly of the second preferred embodiment of a reinforcing apparatus of this invention.
Figure 12:
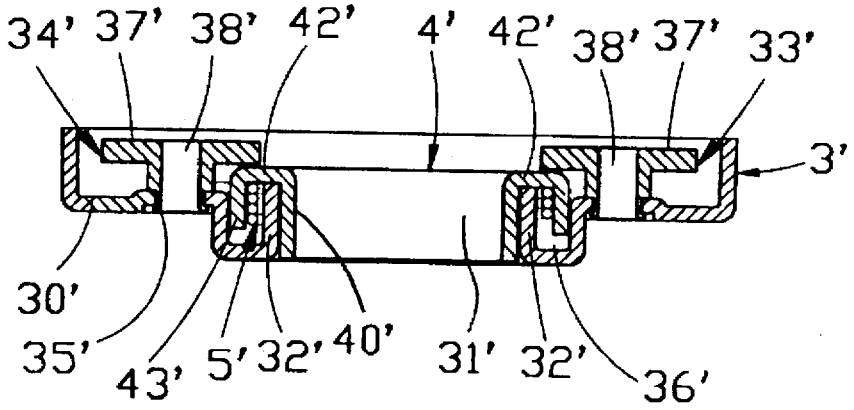
FIG. 12 is a sectional view, taken along the line XII—XII of FIG. 11, showing the reinforcing apparatus of this invention.
Figure 13:
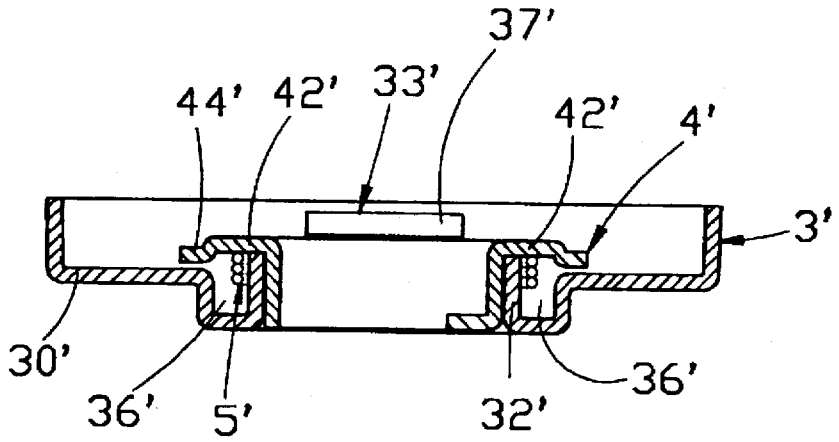
FIG. 13 is sectional view, taken along the line XIII—XIII of FIG. 11, showing the reinforcing apparatus of this invention.

FIGS. 11, 12 and 13 show a reinforcing apparatus of the second preferred embodiment of this invention. As shown, the reinforcing apparatus has the same function as that of the first embodiment, and still includes a housing 3' for carrying a rotary member 4' and a coiled spring 5' of the reinforcing apparatus.

The housing 3' has a wall 30' transverse to a driving shaft (not shown). The wall 30' has a hole 31' formed therethrough for passage of the driving shaft, and a sleeve portion 32' (see FIG. 12) which confines the hole 31'. A pair of first and second protrusions 33', 34' are preferably in the form of hollow stubs that are positioned respectively in two diametrically opposed positioning holes 35' of the wall 30' with the use of a tool (not shown). The first protrusion 33' acts as a confining means similar in function to the first embodiment. The second protrusion 34' acts as a stopping means similar in function to the first embodiment.

The rotary member 4' includes a tubular portion 40' which is sleeved on the driving shaft. The tubular portion 40' is mounted within and is in sliding contact with the sleeve portion 32' of the housing 3'. An engagement tongue 41' projects radially and inwardly from an inner face of one end of the tubular portion 40' to engage the driving shaft in a known manner. Accordingly, the tubular portion 40' can rotate simultaneously with the driving shaft when a lever handle, which is connected to the driving shaft, is actuated. The rotary member 4' further includes an annular flange 42' which projects axially from the outer face of the other end of the tubular portion 40', an engaging plate 43' which projects axially from the outer peripheral edge of the annular flange 42', and a pair of lugs 44' which project radially and outwardly from an outer peripheral edge of the annular flange 42' and which are spaced diametrically from each other. Each of the lugs 44' is engageable with the first protrusion 33' to limit an angular distance that the rotary member 4' travels as described in the first embodiment.

The wall 30' of the housing 3' further has a channel 36' of U-shaped cross-section which extends around the sleeve portion 32' to receive the coiled spring 5' which is sleeved around an outer face of the sleeve portion 32'. The channel 36' is open at one side thereof adjacent to the annular flange 42' so that the annular flange 42' extends over the opening of the channel 36'. In this way, the coiled spring 5' is retained within the channel 36'. At the same time, two legs 51' of the coiled spring 5' engage respectively two opposite axial edges of the engaging plate 43'. The engaging plate 43' acts as an engaging means similar in function to the first embodiment. The distal ends of the legs 51' are supported respectively by two opposite sides of the second protrusion 34' to maintain immobility of one of the legs 51' of the coiled spring 5' when the other one of the legs 51' is pushed by the engaging plate 43' due to rotation of the rotary member 4'. Each of the first and second protrusions 33', 34' further includes a circular head 37' which extends over a portion of the annular flange 42' and which acts as a retaining means to prevent release of the rotary member 4' from the housing 3'.

Preferably, the housing 3' can be fixed to a door by means of two bolts (not shown) which extend respectively through two axial holes 38' of the first and second protrusions 33', 34' of the housing 3' to engage one side wall of the door.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangement.

We claim:

1. A lever handle of a door lock, which is reinforced to maintain a horizontal position comprising:

a driving shaft connected to said lever handle;

a housing provided around said driving shaft and having a wall transverse to said driving shaft, said wall having an outer side facing said lever handle and an inner side which is opposite to said outer side, said wall further having a tubular wall portion which projects axially from said wall and which defines a hole for passage of said driving shaft, said tubular wall portion having a distal end portion;

a rotary member mounted on said housing for rotating simultaneously with said driving shaft, said rotary member being received in said hole and surrounded by said tubular wall portion;

said rotary member having first means projecting radially and outwardly therefrom to bear against said wall so as to prevent an axial and outward releasing movement of said rotary member, said rotary member further having second means which projects radially and outwardly to engage said distal end portion for preventing an axial and inward releasing movement of said rotary member, said first and second means being one piece with said rotary member;

a coiled spring sleeved around said rotary member and having two ends in the form of legs;

said rotary member further having means for engaging one of said legs of said coiled spring, said engaging means projecting from and being one piece with said rotary member, said engaging means generating a stress on said coiled spring upon rotation of said rotary member; and said housing further including a stopping means provided on said wall thereof so as to immobilize the other one of said legs of said coiled spring.

2. A lever handle as claimed in claim 1, wherein said rotary member has a tubular portion which is received in said hole and which has a first end and a second end opposite to said first end, said second means including a retaining nose which projects radially and outwardly from said tubular portion adjacent to said second end to engage said distal end portion.

3. A lever handle as claimed in claim 2, wherein said first means includes at least one lug which projects radially and outwardly from said first end of said tubular portion of said rotary member to said inner side of said wall.

4. A lever handle as claimed in claim 2, wherein said first means further has an annular flange which extends radially and outwardly from said first end of said tubular portion of said rotary member, and at least one lug projecting radially and outwardly from said annular flange to said inner side of said wall.

5. A lever handle as claimed in claim 4, wherein said engaging means has an engaging plate which projects axially from said annular flange of said rotary member.

6. A lever handle as claimed in claim 5, wherein said engaging plate has two opposite axial engaging edges, said legs of said coiled spring projecting radially and outwardly to engage said two opposite axial engaging edges, respectively.

7. A lever handle as claimed in claim 1, wherein said distal end portion has an annular projection which extends inwardly therefrom.

8. A lever handle as claimed in claim 7, wherein said coiled spring is positioned between said annular projection of said housing and an annular flange of said rotary member.

9. A lever handle as claimed in claim 7, wherein said second means includes a retaining nose which projects radially and outwardly from a tubular portion of said rotary member, said annular projection having a notch, said retaining nose moving past said annular projection through said notch in assembly, said annular projection preventing the axial and inward releasing movement of said retaining nose after assembly.

10. A lever handle as claimed in claim 1, further comprising means for confining rotation of said rotary member within a predetermined angle.

11. A lever handle as claimed in claim 10, wherein said confining means includes a first protrusion which is provided on said wall of said housing and which is spaced angularly from said stopping means, said first means of said rotary member being engageable with said first protrusion to limit an angular distance that said rotary member travels.

12. A lever handle as claimed in claim 11, wherein said stopping means is a second protrusion which is provided on and which projects axially from said wall of said housing.

13. A lever handle as claimed in claim 12, wherein said first and second protrusions are formed integrally with said wall of said housing.

14. A lever handle as claimed in claim 13, wherein said first and second protrusions and diametrically opposite to each other.

15. A lever handle as claimed in claim 1, wherein said housing further comprises a circumferential wall extending from said wall in a direction away from said tubular wall portion, said circumferential wall having an outer circumferential surface which is formed with indentations and slots, each of said slots being formed adjacent to one of said indentations.

* * * * *